US011766719B2

(12) United States Patent
Voglewede et al.

(10) Patent No.: US 11,766,719 B2
(45) Date of Patent: Sep. 26, 2023

(54) VARIABLE DENSITY DOWNHOLE DEVICES

(71) Applicant: Halliburton Energy Services, Inc., Houston, TX (US)

(72) Inventors: Daniel Brendan Voglewede, Spring, TX (US); Matthew S. Farny, Magnolia, TX (US); Grant O. Cook, III, Spring, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 237 days.

(21) Appl. No.: 16/898,199

(22) PCT Filed: Feb. 26, 2018

(86) PCT No.: PCT/US2018/019775

§ 371 (c)(1),
(2) Date: Jun. 10, 2020

(87) PCT Pub. No.: WO2019/164534

PCT Pub. Date: Aug. 29, 2019

(65) Prior Publication Data

US 2020/0398343 A1 Dec. 24, 2020

(51) Int. Cl.

| | |
|---|---|
| ***B22F 5/00*** | (2006.01) |
| ***B22F 7/08*** | (2006.01) |
| ***E21B 10/42*** | (2006.01) |
| ***E21B 10/54*** | (2006.01) |

(52) U.S. Cl.

CPC ..... *B22F 5/00* (2013.01); *B22F 7/08* (2013.01); *E21B 10/42* (2013.01); *E21B 10/54* (2013.01); *B22F 2005/001* (2013.01); *B22F 2302/10* (2013.01)

(58) Field of Classification Search

None

See application file for complete search history.

(56) References Cited

U.S. PATENT DOCUMENTS

| | | | | |
|---|---|---|---|---|
| 10,190,639 | B2 * | 1/2019 | Campbell | F16C 35/042 |
| 2006/0231293 | A1 * | 10/2006 | Ladi | B22D 19/14 175/425 |

(Continued)

FOREIGN PATENT DOCUMENTS

| | | | |
|---|---|---|---|
| WO | 2016178693 | 11/2016 | |
| WO | WO-2016178693 A1 * | 11/2016 | B22F 7/08 |
| WO | 2017003574 | 1/2017 | |

OTHER PUBLICATIONS

ISRWO International Search Report and Written Opinion for PCT/US2018/019775 dated Oct. 25, 2018.

*Primary Examiner* — Daniel J. Schleis

(74) *Attorney, Agent, or Firm* — Michael Jenney; C. Tumey Law Group PLLC

(57) ABSTRACT

A metal-matrix composite tool includes a matrix region. The matrix region has a reinforcement material, an outer surface, and an inner, localized area spaced apart from the outer surface within the reinforcement material. The reinforcement material has a reinforcement density and the localized area has a localized density different from the reinforcement density. The matrix region has an overall matrix density different from both the reinforcement density and the localized density.

20 Claims, 13 Drawing Sheets

(56) References Cited

U.S. PATENT DOCUMENTS

| | | | | |
|---|---|---|---|---|
| 2008/0029310 | A1* | 2/2008 | Stevens | C22C 29/00 175/375 |
| 2010/0193254 | A1* | 8/2010 | Lind | B22F 7/08 175/426 |
| 2011/0000715 | A1* | 1/2011 | Lyons | B23K 35/24 175/428 |
| 2013/0247475 | A1 | 9/2013 | Lind et al. | |
| 2016/0375486 | A1 | 12/2016 | Cook, III | |
| 2017/0107764 | A1 | 4/2017 | Cook, III et al. | |
| 2017/0191315 | A1 | 7/2017 | Saini et al. | |

* cited by examiner

VARIABLE DENSITY DOWNHOLE DEVICES

TECHNICAL FIELD

The present description relates in general to downhole tools and tool manufacturing, and more particularly and without limitation, to downhole tools with varying densities and methods of manufacturing thereof.

BACKGROUND OF THE DISCLOSURE

A wide variety of tools are commonly used in the oil and gas industry for forming wellbores, in completing wellbores that have been drilled, and in producing hydrocarbons such as oil and gas from completed wells. Examples of such tools include cutting tools, such as drill bits, reamers, stabilizers, and coring bits; drilling tools, such as rotary steerable devices and mud motors; and other downhole tools, such as window mills, packers, tool joints, and other wear-prone tools. Tools and components thereof are often formed as or using metal-matrix composites ("MMCs").

An MMC tool is typically manufactured by placing loose powder reinforcing material into a mold and infiltrating the powder material with a binder material, such as a metallic alloy. The various features of the resulting MMC tool may be provided by shaping the mold cavity and/or by positioning temporary displacement materials within interior portions of the mold cavity. A quantity of the reinforcement material may then be placed within the mold cavity with a quantity of the binder material. The mold is then placed within a furnace and the temperature of the mold is increased to a desired temperature to allow the binder (e.g., metallic alloy) to liquefy and infiltrate the matrix reinforcement material.

MMC tools are generally erosion-resistant and exhibit high stiffness and strength. The outer surfaces of MMC tools are commonly required to operate in extreme conditions. As a result, it may prove advantageous to customize the material properties of the MMC tools for an intended application.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present description relates in general to downhole tools and tool manufacturing, and more particularly and without limitation, to downhole tools with varying densities and methods of manufacturing thereof.

High-density powder reinforcing material utilized within an MMC tool can allow for erosion resistance and high impact strength. However, powder reinforcing material can be costly and can amount to more than a third of tool manufacturing costs. In certain applications, MMC tools may only require erosion resistance and high impact strength on the outer surfaces of the MMC tool. Therefore, the amount of powder reinforcing material utilized in an MMC tool can be reduced by reducing the density of powder reinforcing material used in areas away from the outer surface without compromising erosion resistance, stiffness, and strength. Further, areas of reduced powder density within the tool can allow higher material toughness to resist cracks and otherwise prevent tool failure. Certain approaches to reducing the density of the powder reinforcing material within the tool, such as by avoiding vibrating or packing the powder within the mold, can reduce the overall density of the powder, but may introduce defects within the MMC tool.

An aspect of at least some embodiments disclosed herein is that by having localized areas of modified density, the amount of powder used in the tool can be decreased. A further aspect, according to at least some embodiments disclosed herein, is that by utilizing localized areas of modified density, the performance attributes of the tool can be customized. Yet another aspect, according to at least some embodiments disclosed herein, is that by utilizing localized areas of modified density, cracks and failure of the tool can be reduced by increasing toughness. Further, according to at least some embodiments disclosed herein, inserts can be utilized to create localized areas of modified density.

The embodiments of the present disclosure are applicable to any tool or device formed as, or incorporating components formed as, a metal-matrix composite (MMC). Such tools or devices are referred to herein as "MMC tools." For purposes of explanation and description only, the following description focuses largely on drill bits as an example of MMC tools. However, it will be appreciated that the principles of the present disclosure are applicable to other MMC tools.

Figure 1:
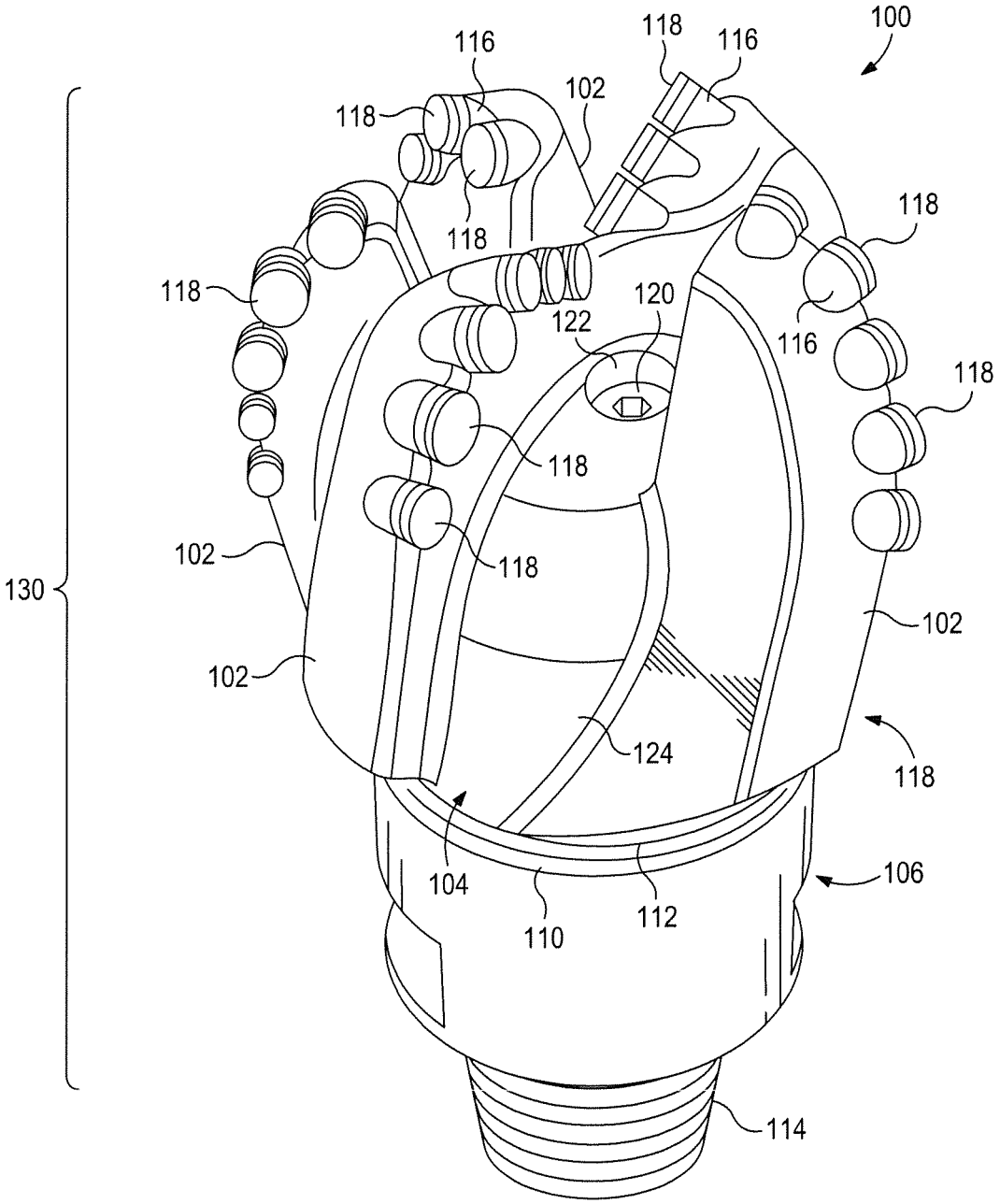
FIG. 1 is a perspective view of an exemplary drill bit that may be fabricated in accordance with the principles of the present disclosure.

FIG. 1 is a perspective view of an exemplary drill bit that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100." Suitable MMC tools used in the oil and gas industry that may be manufactured in accordance with the teachings of the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the drill bit 100 may include or otherwise define a plurality of blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

In the depicted example, the matrix region 130 can include the outer surface 132 of the drill bit 100 and additional portions therein, wherein the matrix region 130 can describe portions of the drill bit 100 that are formed from the reinforcement materials described herein and have a first density (or unmodified density) as further described herein.

Figure 2:
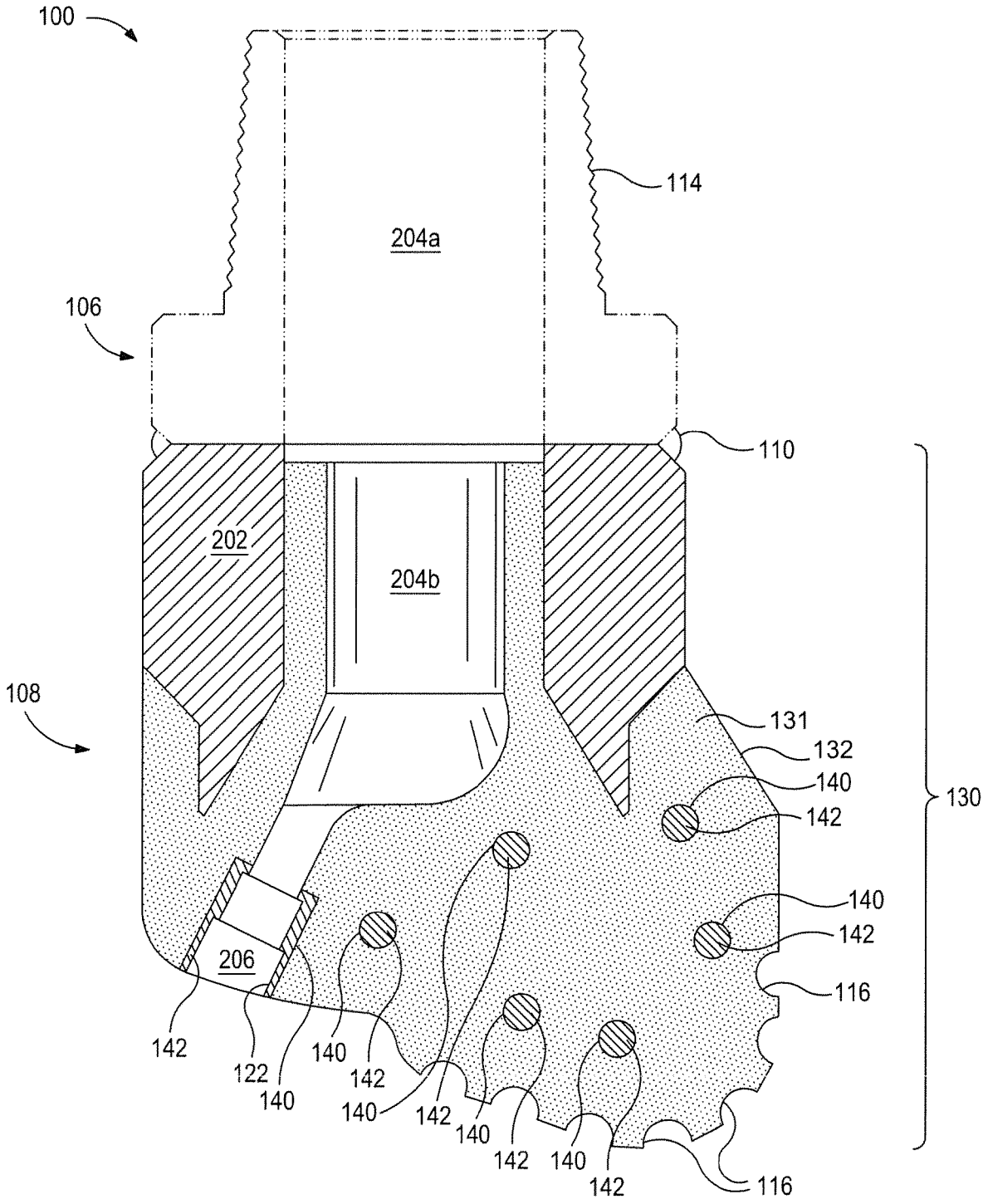
FIGS. 2 and 3 are cross-sectional views of the drill bit of FIG. 1 according to some embodiments of the present disclosure.

FIG. 2 is a cross-sectional view of the drill bit of FIG. 1 according to some embodiments of the present disclosure. Similar numerals from FIG. 1 that are used in FIG. 2 refer to similar components that are not described again. As illustrated, the shank 106 may be securely attached to a metal blank or mandrel 202 at the weld 110, and the mandrel 202 can extend into the bit body 108. The shank 106 and the mandrel 202 are generally cylindrical structures that define corresponding fluid cavities 204*a* and 284*b*, respectively, in fluid communication with each other. The fluid cavity 204*b* of the mandrel 202 may further extend longitudinally into the bit body 108. At least one flow passageway 206 (one shown) may extend from the fluid cavity 204*b* to exterior portions of the bit body 108. The nozzle openings 122 (one shown in FIG. 2) may be defined at the ends of the flow passageways 206 at the exterior portions of the bit body 105. The pockets 116 are formed in the bit body 108 and are shaped or otherwise configured to receive the cutting elements 118.

In the depicted example, the matrix region 130 can include the outer surface 132 of the drill bit 100 but can further include additional portions of the drill bit 100 of a same or similar density, composition, or other material property. In certain embodiments, the matrix region 130 can include a region of homogenous material density. In certain embodiments, the matrix region 130 is 40-60% powder reinforcement material 131 by weight, volume, or density.

In the depicted example, the matrix region 130 is a homogenous mixture of powder reinforcement material 131 and binder with areas of localized density 140 disposed throughout the matrix region 130.

The localized density 140 can be one or more locations within the material of the bit body 108 that exhibits a different density (lower or higher) than a surrounding section of the bit body 108. The localized density 140 can be formed by an insert of another material that is set, immersed and/or encapsulated, and cured into the bit body 108, regardless of whether the material remains discernably distinct from the surrounding bit body 108 or at least partially absorbed into the bit body 108, while still providing a local variation in the density of the bit body 108. These variations in density possible through the localized density 140 can be random or patterned. Further the local densities 140 can permit the bit body 108 to have desired strength or other properties in select areas of the bit body 108 and/or allow the bit body 108 to be composed of a lesser proportion of costly powder and binder materials that are used in forming the bit body 108.

In certain embodiments, the matrix region 130 can be considered a layer or shell of the drill bit 100 with areas of localized density 140 disposed throughout or within the matrix region 130.

In certain embodiments, the matrix region 130 can be a portion of the drill bit 100 with a constant or variable thickness with areas of localized density 140 disposed within the matrix region 130. The matrix region 130 can be a section of the bit body 108 that extends from an outer surface 132 of the bit body 108 inwardly until reaching one or more of the local densities 140. The shape, thickness, and/or configuration of portions of the matrix region 130 can be constant, random, or patterned according to a predetermined design.

In the depicted example, the areas of localized density 140 are inner solid regions within the matrix region 130. The areas of localized density 140 are formed by the inclusion of inserts 142 that exhibit a different density than the density of matrix region 130. The inserts 142 may combine with material of the matrix region 130 to form an overall matrix density within the matrix region 130. The inserts 142 generally maintain their form or shape as shown in FIG. 2.

In certain embodiments, the areas of localized density 140 are disposed through the matrix region 130 without intersecting the outer surface 132 of the drill bit 100. Therefore, in certain embodiments, the areas of localized density 140 are spaced apart or are otherwise not disposed on the outer surface 132 of the drill bit 100.

Certain areas of localized density 140 within the drill bit 100 may be calculated or located by finite element analysis by identifying areas of varying stress and/or strain within the relatively homogenous density of the outer portion 130.

In certain embodiments, the areas of localized density 140 can have a different density than the matrix region 130. In certain embodiments, the density of the areas of localized density 140 can vary from approximately 10% to 200% of the density of the outer portion 130. For example, the density of the matrix region 130 formed from a composite of tungsten carbide and a copper-based alloy can have a density of approximately 11.5 g/cm$^3$, with areas of localized density having composite densities ranging from approximately 1.15 g/cm$^3$ to 23 g/cm$^3$.

Therefore, certain characteristics of the drill bit 100 can be customized by altering the local density of the drill bit. In certain embodiments, the areas of localized density 140 can have a lower density than the surrounding matrix region 130. By having areas of lower density, the amount of powder reinforcement material 131 used in the drill bit 100 is reduced. Further, by having areas of lower density, material toughness of the drill bit in the areas of localized density 140 can be increased, which can prevent or arrest cracks that may propagate through stiffer portions of the drill bit 100, such as the matrix region 130.

In certain embodiments, the areas of localized density 140 can have a greater density than the surrounding matrix region 130. By having areas of greater density, stiffness and erosion resistance in the areas of localized density 140 can be increased in areas that may be exposed to impacts or other areas that require higher strength. For example, an area of localized density 140 with a higher density is shown around the nozzle opening 122 and the flow passageway 206.

Figure 3:
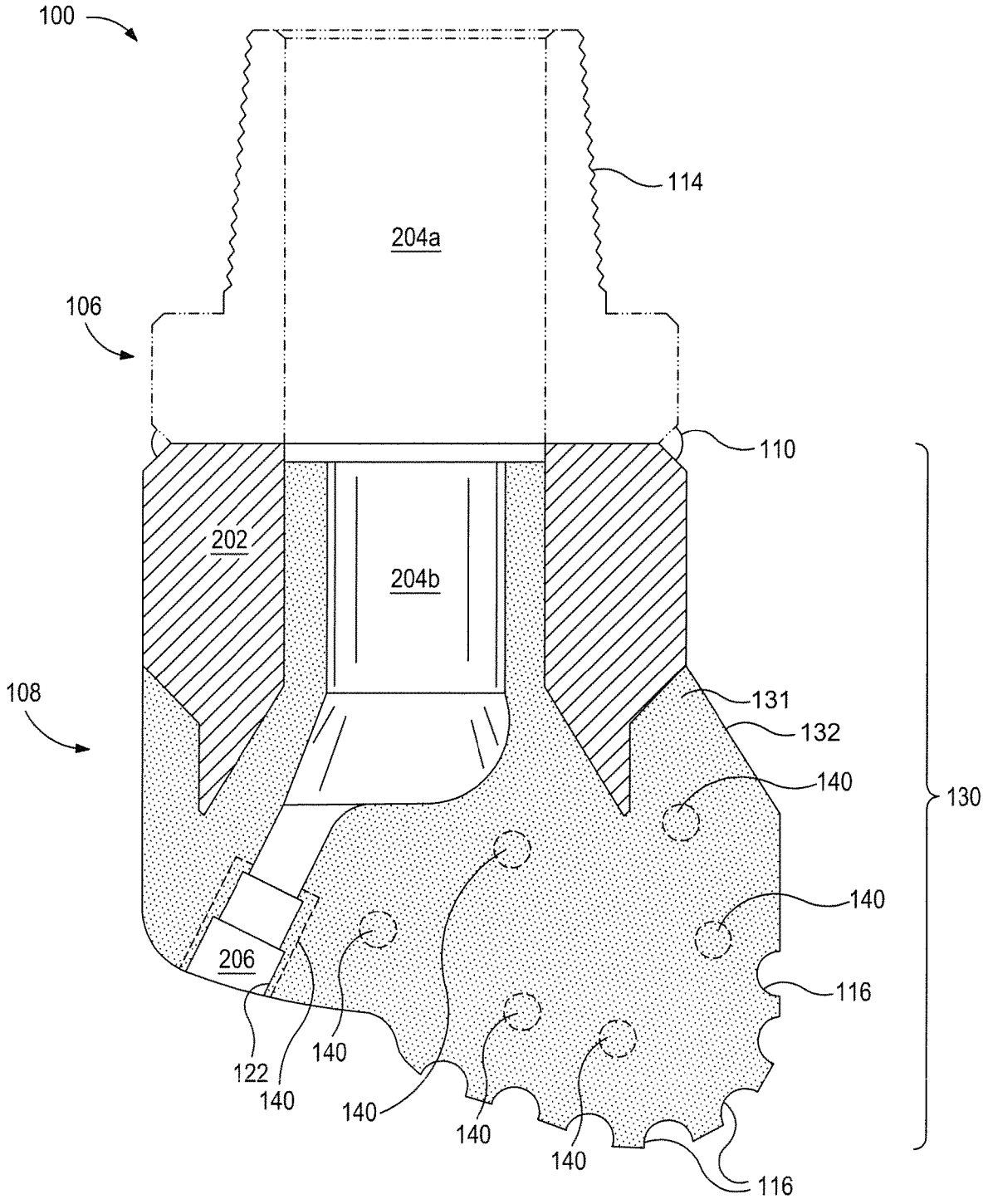

FIG. 3 is a cross-sectional view of the drill bit of FIG. 1 according to some embodiments of the present disclosure. In the depicted example, the areas of localized density 140 are shown as areas without inserts 142. In the depicted example, the areas of localized density 140 are formed by the inclusion of inserts 142 that alter the density of the area of localized density 140 to form a composite density in the immediate area. However, in the depicted example, the inserts 142 are preformed to melt or dissolve while combining with material of the matrix region 130 to form a composite density illustrated by the areas of localized density 140 in areas where the inserts 142 were previously located. As described herein, the inserts 142 can be formed from various materials and with various binders with varying melting temperatures to allow the insert 142 to melt or dissolve within the drill bit 100 leaving behind areas of localized density 140 that may or may not exhibit functional grading of density and other material properties.

Figure 4:
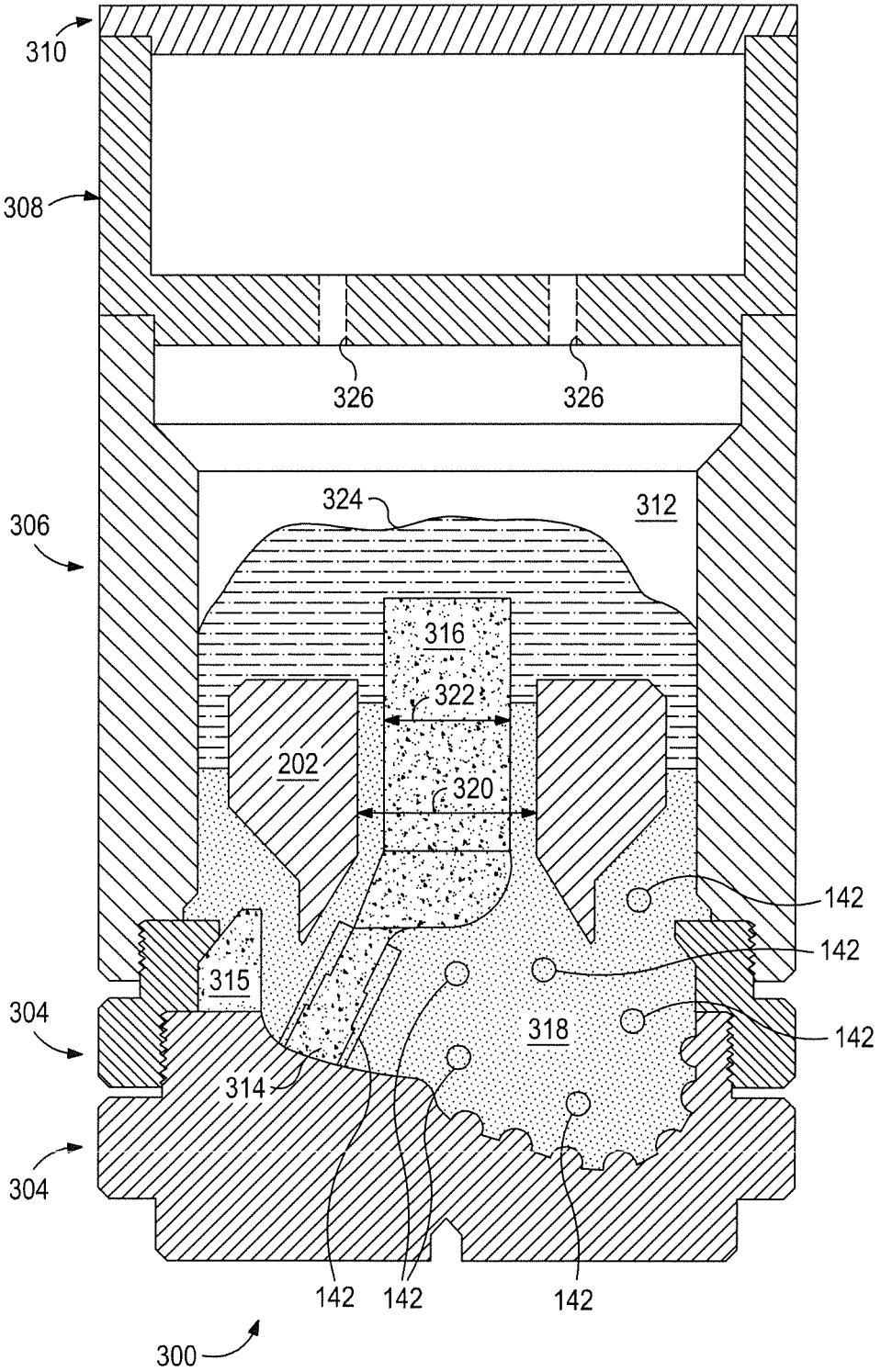
FIG. 4 is a cross-sectional side view of a mold assembly that may be used to fabricate a drill bit according to some embodiments of the present disclosure.

FIG. 4 is a cross-sectional side view of a mold assembly that may be used to fabricate a drill bit according to some embodiments of the present disclosure. While the mold assembly 300 is shown and discussed as being used to help fabricate the drill bit 100, those skilled in the art will readily appreciate that variations of the mold assembly 300 may be used to help fabricate any of the infiltrated downhole tools mentioned above, without departing from the scope of the disclosure.

As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In some embodiments, the mold 302 may be operatively coupled to the gauge ring 304, such as by corresponding threaded engagements, as illustrated. In other embodiments, the gauge ring 304 may be omitted from the mold assembly 300 and the funnel 306 may instead be directly coupled to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100.

Materials, such as consolidated sand or graphite, may be positioned within the mold assembly 300 at desired locations to form various features of the drill bit 100. For example, one or more nozzle displacements 314 (one shown) may be positioned to correspond with desired locations and configurations of the flow passageways 206 and their respective nozzle openings 122. As will be appreciated, the number of nozzle displacements 314 extending from the central displacement 316 will depend upon the desired number of flow passageways and corresponding nozzle openings 122 in the drill bit 100. A cylindrically-shaped consolidated central displacement 316 may be placed on the legs 314. Moreover, one or more junk-slot displacements 315 may also be positioned within the mold assembly 300 to correspond with the junk slots 124.

After the desired materials (e.g., the central displacement 316, the nozzle displacements 314, the junk slot displacement 315, etc.) have been installed within the mold assembly 300, reinforcement materials 318 may then be placed within or otherwise introduced into the mold assembly 300. The reinforcement materials 318 may include, for example, various types of reinforcing powders. Suitable reinforcing powders include, but are not limited to, powders of metals, metal alloys, superalloys, intermetallics, borides, carbides, nitrides, oxides, ceramics, diamonds, and the like, or any combination thereof.

Examples of suitable reinforcing powders include, but are not limited to, tungsten, molybdenum, niobium, tantalum, rhenium, iridium, ruthenium, beryllium, titanium, chromium, rhodium, iron, cobalt, uranium, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, any mixture thereof, and any combination thereof. In some embodiments, the reinforcing powders may be coated, such as diamond coated with titanium.

The mandrel 202 may be supported at least partially by the reinforcement materials 318 within the infiltration chamber 312. More particularly, after a sufficient volume of the reinforcement materials 318 has been added to the mold assembly 300, the mandrel 202 may then be placed within mold assembly 300. The mandrel 202 may include an inside diameter 320 that is greater than an outside diameter 322 of the central displacement 316, and various fixtures (not expressly shown) may be used to position the mandrel 202 within the mold assembly 300 at a desired location. The reinforcement materials 318 may then be filled to a desired level within the infiltration chamber 312.

Binder material 324 may then be placed on top of the reinforcement materials 318, the mandrel 202, and the central displacement 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of alloys of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 324 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling; and any combination thereof.

In some embodiments, the binder material 324 may be covered with a flux layer (not expressly shown). The amount of binder material 324 (and optional flux material) added to the infiltration chamber 312 should be at least enough to infiltrate the reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300. The mold assembly 300 and the materials disposed therein may then be preheated and subsequently placed in a furnace (not shown). When the furnace temperature reaches the melting point of the binder material 324, the binder material 324 will liquefy and proceed to infiltrate the reinforcement materials 318.

After a predetermined amount of time allotted for the liquefied binder material 324 to infiltrate the reinforcement materials 318, the mold assembly 300 may then be removed from the furnace and cooled at a controlled rate to cure. Once cooled, the mold assembly 300 may be broken away to expose the bit body 108. Subsequent machining and post-processing according to well-known techniques may then be used to finish the drill bit 100.

According to embodiments of the present disclosure, the drill bit 100, or any of the MMC tools mentioned herein, may be fabricated to include areas of localized densities by the introduction of inserts 142 as described herein. As previously described, the inserts 142 can have a different density than the reinforcing materials 318. The inserts 142 displace the reinforcing materials 318 to reduce the amount of reinforcing materials 318 required. In certain embodiments, the inserts 142 have a lower density than the reinforcing materials 318 to alter the overall density of the drill bit 100. In certain embodiments, the inserts 142 can have a greater density than the reinforcing materials 318 to increase strength in selected locations. For example, inserts 142 can be introduced in areas adjacent or continuous to voids such as the nozzle displacements 314 to form a reinforced area around the nozzle of the drill bit 100.

In the depicted example, the inserts 142 are preformed before introduction into the reinforcement materials 318. The inserts 142 can be formed as a metal matrix composite insert in a similar manner as described with respect to the drill bit 100 or any other method known for an MMC tool.

In certain embodiments, the inserts 142 can be formed from the same or similar materials as the reinforcement materials 318. Examples of suitable insert materials include, but are not limited to, alumina, tungsten, molybdenum, niobium, tantalum, rhenium, iridium, ruthenium, beryllium, titanium, chromium, rhodium, iron, cobalt, uranium, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYES® alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, any mixture thereof, and any combination thereof in some embodiments, the insert powders may be coated, such as diamond coated with titanium.

In certain embodiments, the inserts 142 can utilize a same or similar binder as used within the drill bit 100. Suitable binder materials for the insert 142 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of alloys of the binder material for the inserts 142 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials for insert 142 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling; and any combination thereof.

In certain embodiments, the binder of the insert 142 can be selected to have a same or lower melting point than the melting point of the binder 324 used in the formation of the drill bit 100. For example, the insert 142 may melt or break apart during the manufacturing process leaving behind localized areas of density 140 as shown in FIG. 3. In certain embodiments, the binder of the insert 142 can be selected to be a refractory binder or to have a higher melting point than the binder 324 used in the formation of the drill bit 100, which allows the inserts 142 to remain intact within the drill bit 100 after formation as shown in FIG. 2.

The inclusion of the insert 142 can result in a localized region having a particle size distribution that differs from the surrounding portions of the drill bit 100. For example, the insert 142 can create a localized region within the drill bit 100 wherein the average or median particle size is greater than the surrounding particles within the outermost or surrounding regions that are formed by the reinforcement materials 318. Alternatively, the insert 142 can create a localized region within the drill bit 100 wherein the average or median particle size is less than the surrounding particles within the outermost or surrounding regions that are formed by the reinforcement materials 318.

In certain embodiments, the insert 142 can be formed from scrap materials, such as material scrapped from previously formed or defective tools. In certain embodiments, scrap materials can have the same or similar properties as described herein and can be introduced into the reinforcing material 318.

Figure 5A:
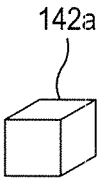
FIGS. 5A-5J are perspective views of inserts according to some embodiments of the present disclosure.
Figure 5B:
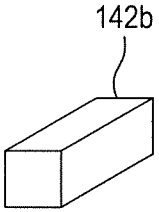
Figure 5C:
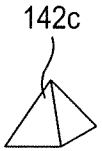
Figure 5D:
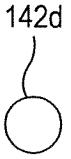
Figure 5E:
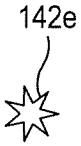
Figure 5G:
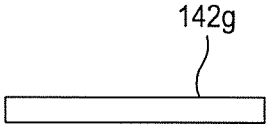
Figure 5F:
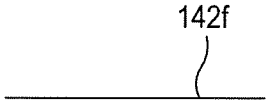
Figure 5J:
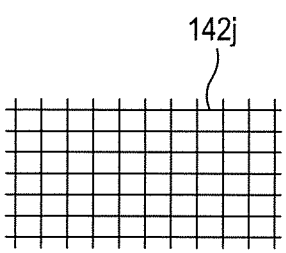
Figure 5I:
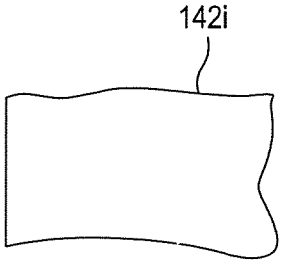
Figure 5H:
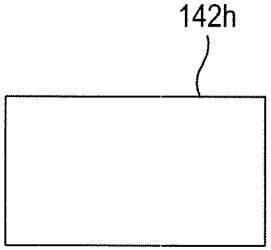

FIGS. 5A-5J are perspective views of inserts according to some embodiments of the present disclosure. According to some embodiments, the shape of the insert 142 can be selected to provide a desired density and overall performance of the resulting drill bit 100. Referring to FIG. 5A, a cube shaped insert 142*a* is shown. Referring to FIG. 5B, a rectangular prism shaped insert 142*b* is shown. Referring to FIG. 5C, a tetrahedron 142*c* is shown which is representative of a prismatic shaped insert. Referring to FIG. 5D, a spherical shaped insert 142*d* is shown. Referring to FIG. 5E, a star shaped insert 142*e* is shown. Referring to FIG. 5F, the insert 142*f* can be formed as a fiber that is rigid or flexible. Referring to FIG. 5G, the insert 142*g* can be formed as a rod that is hollow or solid. Referring to FIG. 5H, the insert 142*h* can be a formed as a rigid or semi-rigid sheet. Referring to FIG. 5I, the insert 142*i* can be formed as a flexible foil. Referring to FIG. 5J, the insert 142*j* can be formed in a grid or lattice shape. However, the insert 142 can be randomly formed of one or more constituent materials and in any shape or in a predetermined shape and constitution.

In certain embodiments, the inserts 142 can include a rough outer surface or other surface features to prevent migration of the inserts 142 within the reinforcing material 318 or to provide mechanical interlocking of the inserts 142 with the reinforcing material 318. In certain embodiments, the inserts 142 can mate with features within the mold assembly 300.

The inserts 142 can be any size, for example ranging from 0.1 inches to 3 inches in a characteristic dimension. The inserts 142 can be any combination of sizes, shapes, surface treatments, reinforcement materials, and binders described herein.

According to some embodiments, the inserts 142 can be introduced to the reinforcing material 318 at various stages or using various approaches during the manufacturing process, as described herein. In some embodiments, the inserts 142 are immersed, encapsulated, or otherwise surrounded by the reinforcing material 318 during and after formation. Approaches to introduce the combination of the inserts 142 and the reinforcing material 318 can include, but are not limited to: (1) premixing inserts with the reinforcing material and introducing the mixture into the mold; (2) introducing reinforcing material in a first portion, introducing inserts, and then introducing another portion of reinforcing material, repeating such process as desired, until a sufficient amount of reinforcing material has been added; (3) introducing inserts into a mold assembly and then introducing the reinforcing material into the mold; and (4) some combination of methods (1), (2), and/or (3).

Figure 6A:
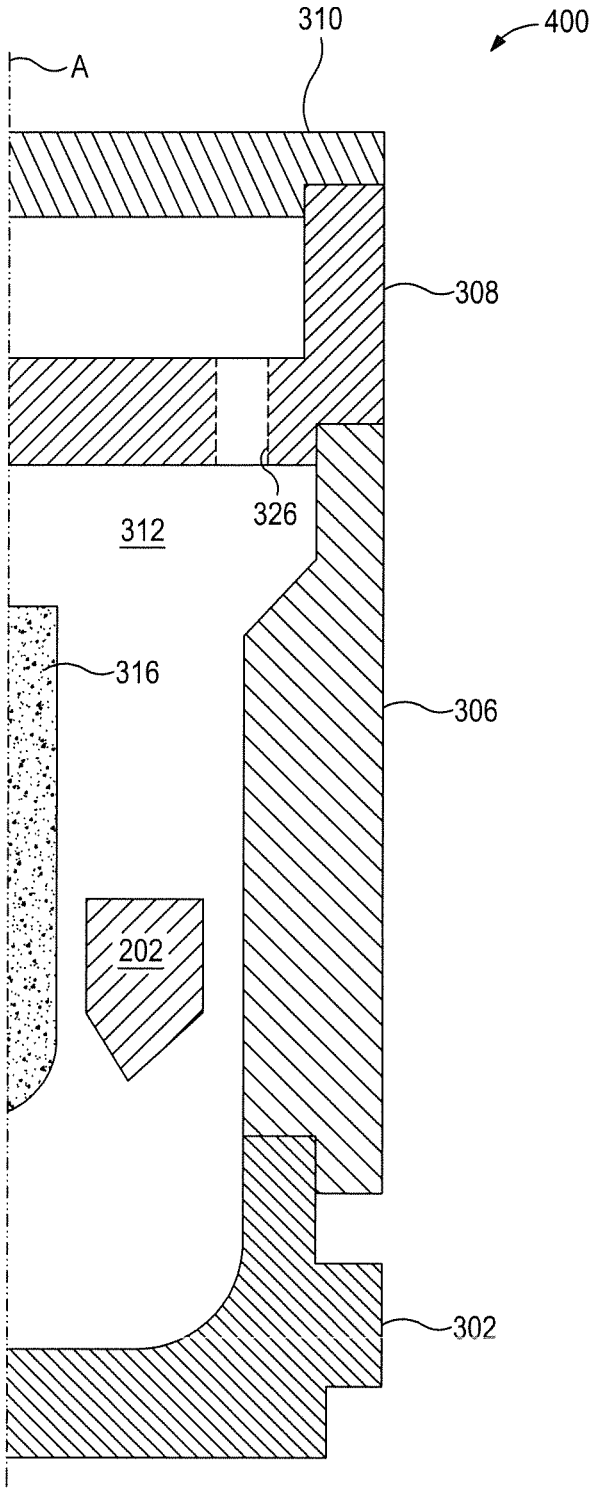
FIGS. 6A-8B are cross-sectional side views of a mold assembly that may be used to fabricate a drill bit according to some embodiments of the present disclosure.

FIG. 6A is a cross-sectional side view of a mold assembly that may be used to fabricate a drill bit according to some embodiments of the present disclosure. For simplicity, only half of the mold assembly 400 is shown as taken along a longitudinal axis A of the mold assembly 400. It should be noted that the mold assemblies illustrated in successive figures are simplified approximations of the mold assembly 300 of FIG. 4 that allow for more simple schematics and straightforward explanations of the various embodiments. Furthermore, due to the asymmetric nature of straight-through cross sections for drill bits with an odd number of blades, successive cross-sectional figures are restricted to half sections to illustrate simplified generalized configurations that are applicable to drill bits of varying numbers of blades in addition to different portions of drill bits, such as blade sections and junk-slot sections. It will be appreciated that embodiments illustrated in these half sections may be transferrable from blade regions to junk-slot regions by simply forming holes for positioning around the nozzle displacements 314.

Referring to FIG. 6A, the mold assembly 400 may be similar in some respects to the mold assembly 300 of FIG. 4 and therefore may be best understood with reference thereto, where like numerals represent like elements not described again in detail. Similar to the mold assembly 300, for instance, the mold assembly 400 may include the mold 302, the funnel 306, the binder bowl 308, and the cap 310. While not shown in FIG. 6A, in some embodiments, the gauge ring 304 may also be included in the mold assembly 400. The mold assembly 400 may further include the mandrel 202, the central displacement 316, and one or more nozzle displacements or legs 314, as generally described above.

According to some embodiments, reinforcement material 318 can be premixed with inserts 142 to form a mixture 318*a* before introduction into the mold assembly 400. The inserts 142 can be mixed with the reinforcement material 318 to be evenly dispersed or in a desired distribution within the mixture 318*a*. The volume of inserts 142 can be varied to increase or reduce the density of the mixture 318*a* to provide a desired overall density of the resulting drill bit 100.

Figure 6B:
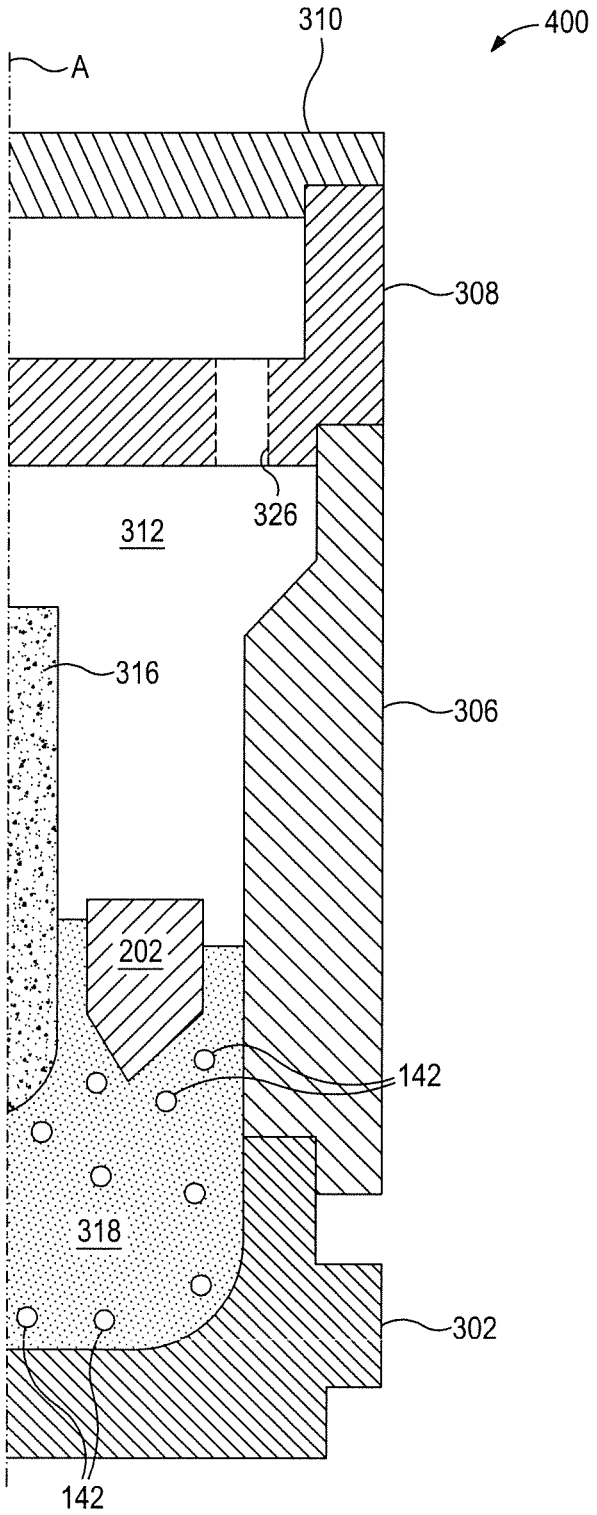

FIG. 6B is a cross-sectional side view of a mold assembly that may be used to fabricate a drill bit according to some embodiments of the present disclosure. FIG. 6B depicts the mold assembly 400 after loading the mixture 318*a* into the infiltration chamber 312. The introduced inserts 142 can result in a drill bit 100 exhibiting localized areas of modified densities following infiltration. For instance, the inserts 142 selected for the mixture 318*a* may result in a drill bit 100 with various areas of lower density and increased ductility, while reinforcement material 318 can result in a matrix region having a stiff or hard outer shell.

Figure 7A:
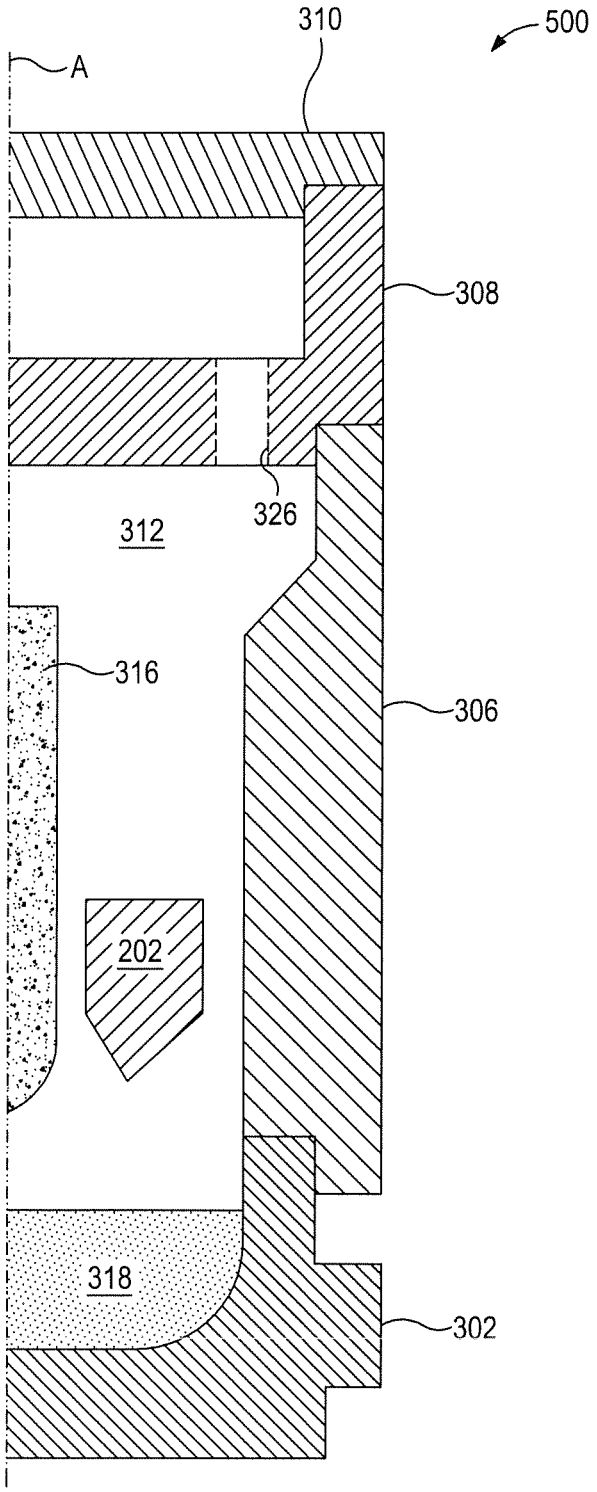

FIG. 7A is a cross-sectional side view of a mold assembly that may be used to fabricate a drill bit according to some embodiments of the present disclosure. FIG. 7A depicts a mold assembly 500 after loading a first portion of reinforcement materials 318.

Figure 7B:
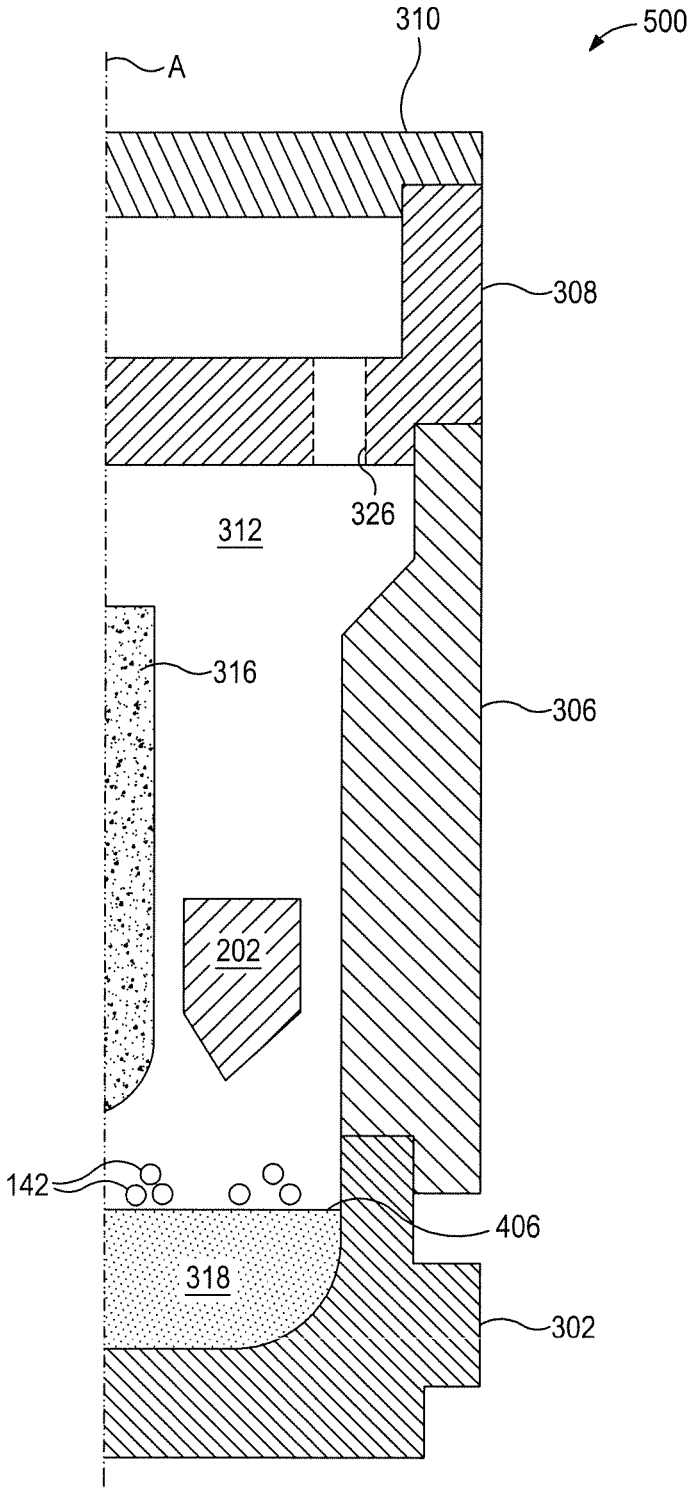

FIG. 7B is a cross-sectional side view of a mold assembly that may be used to fabricate a drill bit according to some embodiments of the present disclosure. FIG. 7B depicts a mold assembly 500 after inserts 142 are introduced into the mold assembly 500. Inserts 142 can be introduced in any distribution and amount, and can be embedded into the first portion of reinforcement materials 318 by manual placement, vibration of the mold assembly 500, or other methods. The inserts 142 can displace any additional reinforcement materials 318 that are introduced, providing desired density characteristics as described herein.

Figure 7C:
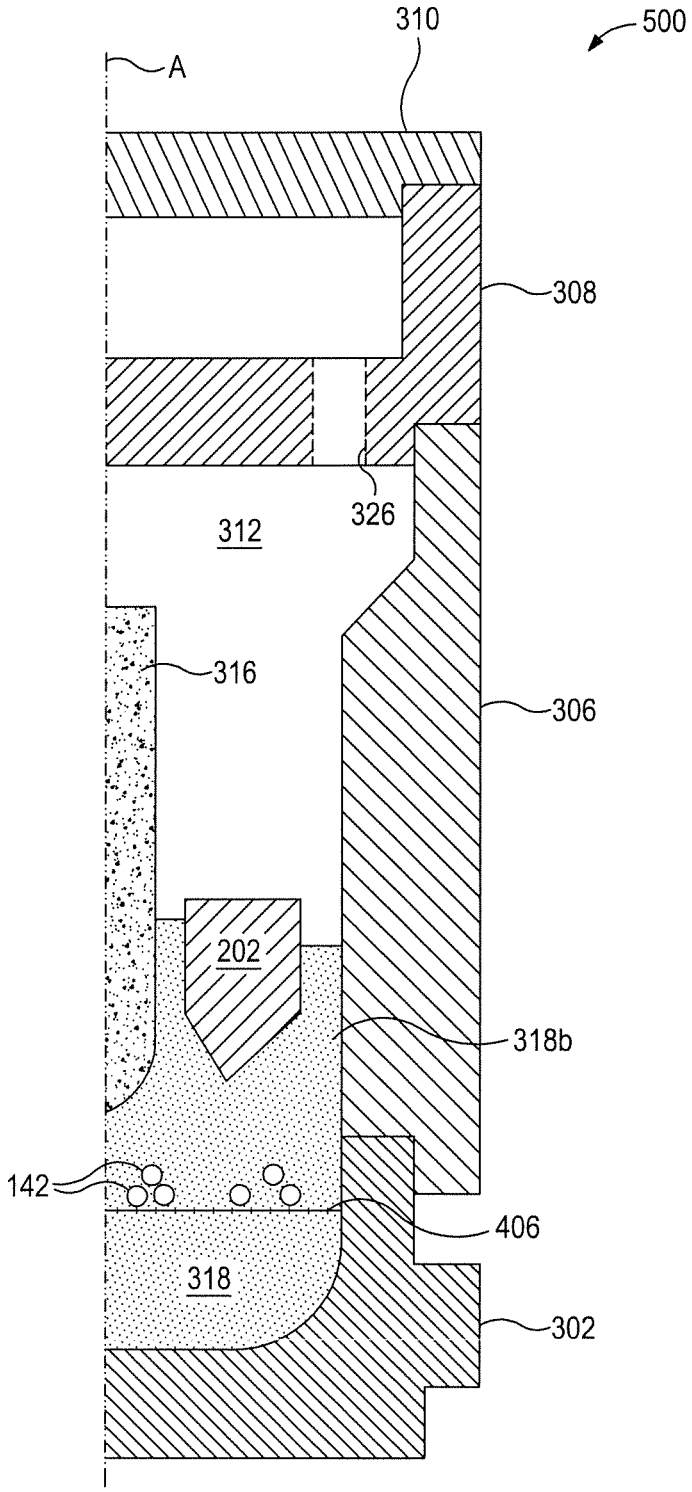

FIG. 7C is a cross-sectional side view of a mold assembly that may be used to fabricate a drill bit according to some embodiments of the present disclosure. FIG. 7C depicts a mold assembly 500 after loading a second portion of reinforcement materials 318*b*. In the depicted example, less reinforcement material 318*b* is required due to the displacement of volume caused by the inserts 142. As illustrated, the reinforcement material 318*b* can infiltrate and/or flow around the inserts 142 the volume between the inserts 142 to fill in the mold assembly 500 without any unintended voids. According to some embodiments, additional inserts and portions of reinforcement material can be introduced to provide desired density characteristics or to provide a desired insert distribution within the drill bit 100.

Figure 8A:
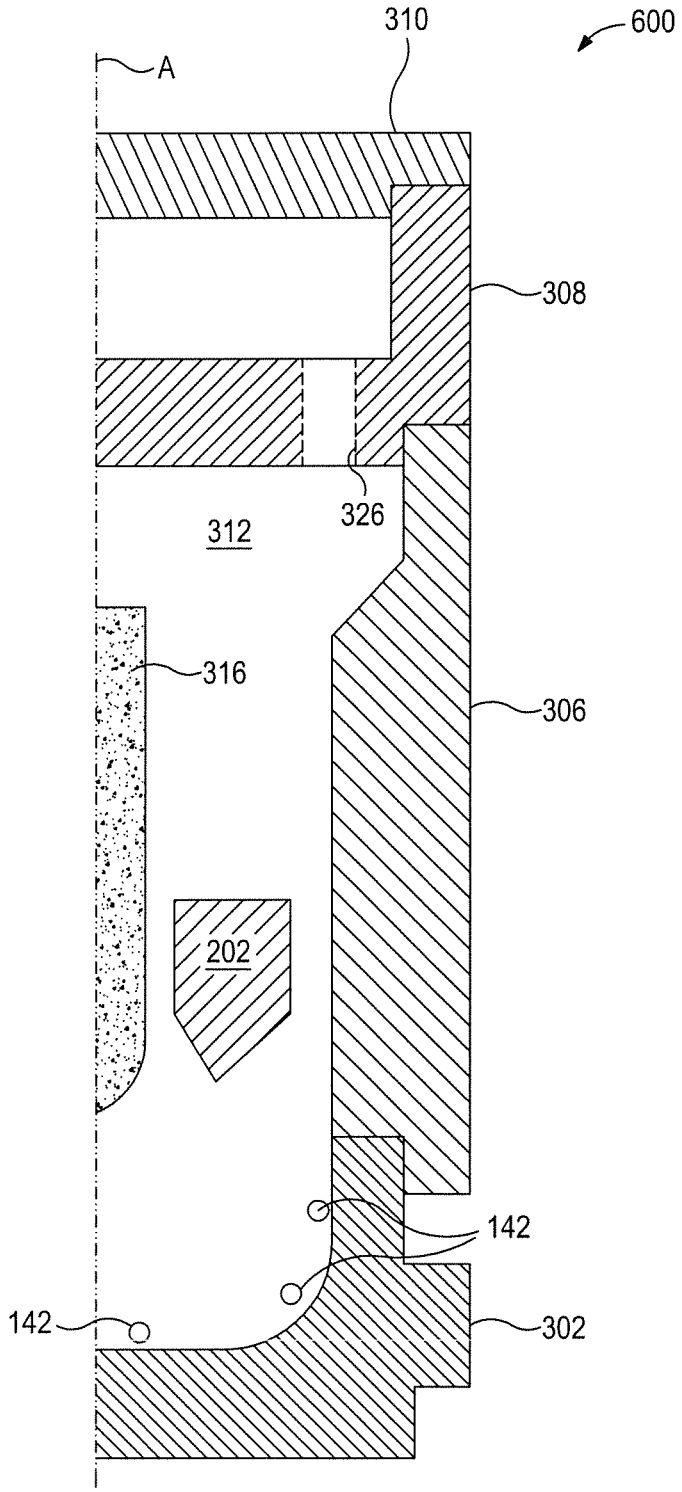

FIG. 8A is a cross-sectional side view of a mold assembly that may be used to fabricate a drill bit according to some embodiments of the present disclosure. FIG. 8A depicts a mold assembly 600 before the introduction of reinforcement materials. According to some embodiments, inserts 142 can be disposed within the mold assembly 600 prior to the introduction of reinforcement materials. In some embodiments, as illustrated, the inserts 142 may be affixed or coupled to the mold assembly 600 such as via tack welds, an adhesive, wire, one or more mechanical fasteners (e.g., screws, bolts, pins, snap rings, etc.), an interference fit, or any combination thereof. In other embodiments, however, the inserts 142 may alternatively be coupled to a feature disposed within the mold assembly 600, such as a centering fixture (not shown) used only during the loading process. Once the loading process is complete, and prior to the infiltration process, the centering fixture would be removed from the mold assembly 600.

Figure 8B:
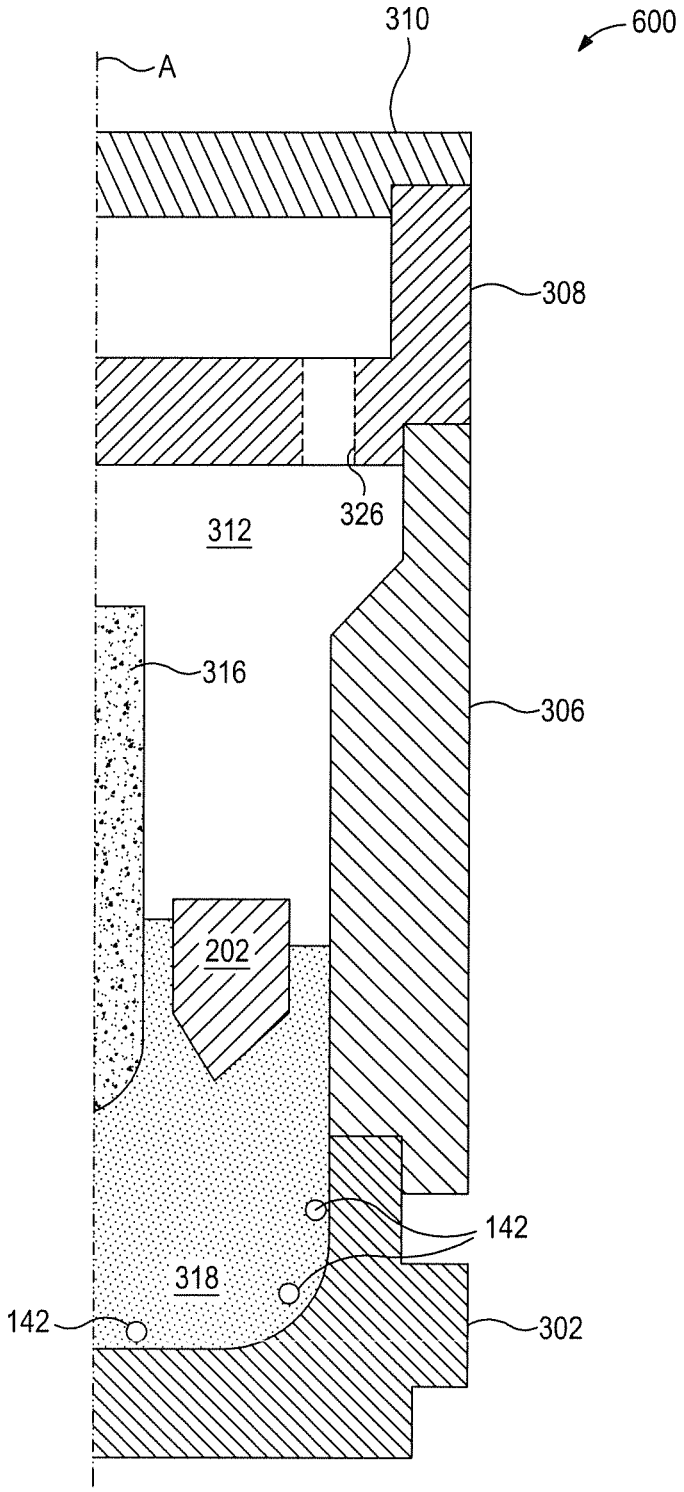

FIG. 8B is a cross-sectional side view of a mold assembly that may be used to fabricate a drill bit according to some embodiments of the present disclosure. FIG. 8B depicts a mold assembly 600 after loading the reinforcement materials 318. In the depicted example, less reinforcement material 318 is required due to the displacement of volume caused by the inserts 142. As illustrated, the reinforcement material 318 can infiltrate into the volume between the inserts 142 to fill in the mold assembly 600 without any unintended voids.

Various examples of aspects of the disclosure are described below as clauses for convenience. These are provided as examples, and do not limit the subject technology.

Clause 1. A drill bit, comprising: a body having: a bit head; a bit shank connected to the bit head; and a nozzle formed through the body, wherein the body has a matrix region having a reinforcement material, an outer surface, and an inner, localized area spaced apart from the outer surface within the reinforcement material, wherein the reinforcement material has a reinforcement density, the localized area has a localized density different from the reinforcement density, and the matrix region has an overall matrix density different from both the reinforcement density and the localized density.

Clause 2. The drill bit of Clause 1, wherein the inner, localized area includes an insert.

Clause 3. The drill bit of Clause 2, wherein the insert is a metal matrix composite insert.

Clause 4. The drill bit of Clause 2, wherein the insert includes tungsten carbide, alumina, boron carbide, vanadium carbide, or titanium carbide.

Clause 5. The drill bit of Clause 2, wherein the insert includes a roughened insert surface.

Clause 6. The drill bit of Clause 2, wherein the insert is a bead, a fiber, a rod, a sheet, a foil, or a mesh.

Clause 7. The drill bit of any preceding Clause wherein the inner solid region is a cube shape, a star shape, a rectangle shape, a triangle shape, or a prismatic shape.

Clause 8. The drill bit of any preceding Clause, wherein the localized density is less than the matrix body density.

Clause 9. The drill bit of any preceding Clause, wherein the localized density is greater than the matrix region density.

Clause 10. The drill bit of any preceding Clause, wherein the inner, localized area includes a portion particle size distribution that is different than a matrix body particle size distribution of the matrix body.

Clause 11. The drill bit of Clause 10, wherein the portion particle size distribution includes an average particle size that is greater than the average particle size of the matrix body particle size distribution.

Clause 12. The drill bit of Clause 10, wherein the portion particle size distribution includes an average particle size that is less than the average particle size of the matrix body particle size distribution.

Clause 13. The drill bit of any preceding Clause, wherein the matrix region includes a void and the inner, localized area is disposed contiguous to the void.

Clause 14. The drill bit of any preceding Clause, wherein the inner, localized area has no voids.

Clause 15. A metal-matrix composite tool, comprising: a matrix region having a reinforcement material, an outer surface, and an inner, localized area spaced apart from the outer surface within the reinforcement material, wherein the reinforcement material has a reinforcement density, the localized area has a localized density different from the reinforcement density, and the matrix region has an overall matrix density different from both the reinforcement density and the localized density.

Clause 16. The metal-matrix composite tool of Clause 15, wherein the inner, localized area includes a solid insert.

Clause 17. The metal-matrix composite tool of Clause 16, wherein the insert comprises a metal matrix composite material.

Clause 18. The metal-matrix composite tool of Clause 16, wherein the insert includes tungsten carbide, alumina, boron carbide, vanadium carbide, or titanium carbide.

Clause 19. The metal-matrix composite tool of Clause 16, wherein the insert includes a roughened insert surface.

Clause 20. The metal-matrix composite tool of Clause 16, wherein the insert is a bead, a fiber, a rod, a sheet, a foil, or a mesh.

Clause 21. The metal-matrix composite tool of Clause 15-20, wherein the inner, localized area is a cube shape, a star shape, a rectangle shape, a triangle shape, or a prismatic shape.

Clause 22. The metal-matrix composite tool of Clause 15-21, wherein the localized density is less than the matrix density.

Clause 23. The metal-matrix composite tool of Clause 15-22, wherein the localized density is greater than the matrix density.

Clause 24. The metal-matrix composite tool of Clause 15-23, wherein the localized area includes a localized area particle size distribution that is different than a surface particle size distribution of the matrix body.

Clause 25. The metal-matrix composite tool of Clause 24, wherein the localized area particle size distribution includes an average particle size that is greater than the average particle size of the matrix body particle size distribution.

Clause 26. The metal-matrix composite tool of Clause 24, wherein the localized area particle size distribution includes an average particle size that is less than the average particle size of the matrix body particle size distribution.

Clause 27. The metal-matrix composite tool of Clause 15-26, wherein the body includes a void and the inner, localized area is disposed adjacent to the void.

Clause 28. The metal-matrix composite tool of Clause 15-27, wherein the metal-matrix composite tool is a drill bit.

Clause 29. The metal-matrix composite tool of Clause 15-28, wherein the body includes tungsten carbide.

Clause 30. The metal-matrix composite tool of Clause 15-29, wherein the inner, localized area has no voids.

Clause 31. A method for forming a metal-matrix composite tool, the method comprising: introducing a combination of a reinforcement powder and preformed insert into a mold, the preformed insert being fully encapsulated within the powder; adding a binder to the mold; and curing the powder and insert with the binder.

Clause 32. The method of Clause 31, further including combining the combination prior to the introducing.

Clause 33. The method of Clause 31 or 32, wherein the introducing includes introducing a mixture of the powder and the insert into the mold.

Clause 34. The method of Clause 31-33, wherein the introducing includes introducing the powder into the mold before introducing the insert.

Clause 35. The method of Clause 34, further including introducing additional reinforcement powder into the mold after introducing the insert.

Clause 36. The method of Clause 31-35, wherein the introducing includes introducing the insert into the mold before introducing the powder.

Clause 37. The method of Clause 36, further including affixing the insert to the mold.

Clause 38. The method of Clause 31-37, further including melting the insert within the mold after the binder is introduced.

Clause 39. The method of Clause 31-38, further including bonding the insert to the mold.

Clause 40. The method of Clause 31-39, wherein the insert includes an insert binder with an insert binder melting temperature higher than a binder melting temperature of the binder.

Clause 41. The method of Clause 40, wherein the insert binder includes a refractory binder.

Clause 42. The method of Clause 31-41, wherein the mold is a graphite mold.

Clause 43. The method of Clause 31-42, further including vibrating the powder within the mold.

Clause 44. The method of Clause 31-43, wherein the insert density is less than the powder density.

Clause 45. The method of Clause 31-44 wherein the insert density is greater than the powder density.

Clause 46. The method of Clause 31-45, wherein the insert includes tungsten carbide, alumina, boron carbide, vanadium carbide, or titanium carbide.

Clause 47. The method of Clause 31-46, wherein the insert includes an insert particle size distribution that is different than a powder particle size distribution of the powder.

Clause 48. The method of Clause 47, wherein the insert particle size distribution includes an average particle size that is greater than the average particle size of the powder particle size distribution.

Clause 49. The method of Clause 47, wherein the insert particle size distribution includes an average particle size that is less than the average particle size of the powder particle size distribution.

Clause 50. The method of Clause 31-49, wherein the insert includes a roughened insert surface.

Clause 51. The method of Clause 31-50, wherein the insert is a bead, a fiber, a rod, a sheet, a foil, or a mesh.

Clause 52. The method of Clause 31-51, wherein the insert is a cube shape, a star shape, a rectangle shape, a triangle shape, or a prismatic shape.

Clause 53. The method of Clause 31-52, wherein the reinforcement powder includes tungsten carbide.

Clause 54. The method of Clause 31-53, wherein the preformed insert is a metal matrix composite insert.

Clause 55. A method for forming a metal-matrix composite tool, the method comprising: introducing a reinforcement powder into a mold, wherein the powder includes a powder density; and introducing a preformed insert into the powder within the mold, wherein the insert includes an insert density different than the powder density.

Clause 56. The method of Clause 55, further including introducing a binder into the mold to infiltrate the powder.

Clause 57. The method of Clause 56, further including melting the insert within the mold after the binder is introduced.

Clause 58. The method of Clause 56, further including bonding the insert to the mold.

Clause 59. The method of Clause 58, wherein the insert includes an insert binder with an insert binder melting temperature higher than a binder melting temperature of the binder.

Clause 60. The method of Clause 59, wherein the insert binder includes a refractory binder.

Clause 61. The method of Clause 56-60, wherein the mold is a graphite mold.

Clause 62. The method of Clause 56-61, further including vibrating the powder within the mold.

Clause 63. The method of Clause 56-62, further including affixing the insert to the mold.

Clause 64. The method of Clause 56-63, wherein the insert density is less than the powder density.

Clause 65. The method of Clause 56-64, wherein the insert density is greater than the powder density.

Clause 66. The method of Clause 56-65, wherein the insert is tungsten carbide, alumina, boron carbide, vanadium carbide, or titanium carbide.

Clause 67. The method of Clause 56-66, wherein the insert includes an insert particle size distribution that is different than a powder particle size distribution of the powder.

Clause 68. The method of Clause 67, wherein the insert particle size distribution includes an average particle size that is greater than the average particle size of the powder particle size distribution.

Clause 69. The method of Clause 67, wherein the insert particle size distribution includes an average particle size that is less than the average particle size of the powder particle size distribution.

Clause 70. The method of Clause 56-69, wherein the insert includes a roughened insert surface.

Clause 71. The method of Clause 56-70, wherein the insert is a head, a fiber, a rod, a sheet, a foil, or a mesh.

Clause 72. The method of Clause 56-71, wherein the insert is a cube shape, a star shape, a rectangle shape, a triangle shape, or a prismatic shape.

Clause 73. The method of Clause 56-72, wherein the reinforcement powder includes tungsten carbide.

Clause 74. The method of Clause 56-73, wherein the preformed insert is a metal matrix composite insert.

What is claimed is:

1. A metal-matrix composite tool, comprising:

a matrix region including a reinforcement material, an outer surface, and an inner, localized area that does not intersect the outer surface of the tool, wherein the outer surface surrounds the reinforcement material and the localized area, wherein the reinforcement material has a reinforcement density, the localized area has a localized density different from the reinforcement density, and the matrix region has an overall matrix density different from both the reinforcement density and the localized density, wherein the localized area includes an insert that includes an outer surface configured to prevent migration of the insert within the reinforcement material or to provide mechanical interlocking of the insert with the reinforcement material, wherein the insert includes a grid or lattice.

2. The metal-matrix composite tool of claim 1, wherein the insert includes a solid insert.

3. The metal-matrix composite tool of claim 2, wherein the solid insert comprises a composite material.

4. The metal-matrix composite tool of claim 1, wherein the localized density is less than the matrix density.

5. The metal-matrix composite tool of claim 1, wherein the localized density is greater than the matrix density.

6. The metal-matrix composite tool of claim 1, wherein the localized area comprises a material different from that of the reinforcement material.

7. The metal-matrix composite tool of claim 1, wherein the localized area comprises a portion of the reinforcement material.

8. The metal-matrix composite tool of claim 1, wherein the reinforcement material comprises tungsten carbide.

9. The metal-matrix composite tool of claim 1, wherein the matrix region includes a void and the localized area is disposed contiguous to the void.

10. The metal-matrix composite tool of claim 1, wherein the metal-matrix composite tool comprises a drill bit.

11. The metal-matrix composite tool of claim 1, further comprising a binder.

12. The metal-matrix composite tool of claim 1, wherein the insert includes a dimension ranging from 0.1 inch to 3 inches.

13. The metal-matrix composite tool of claim 1, wherein the insert includes a sheet.

14. The metal-matrix composite tool of claim 1, wherein the metal-matrix composite tool comprises a drill bit.

15. The metal-matrix composite tool of claim 1, wherein the density of the localized area ranges from 10% to 200% of the density of the outer surface.

16. The metal-matrix composite tool of claim 14, wherein a particle size distribution of the localized area differs from surrounding portions of the drill bit.

17. The metal-matrix composite tool of claim 12, wherein the insert includes material scrapped from a defective tool.

18. The metal-matrix composite tool of claim 16, wherein the average or median particle size is less than surrounding particles within the outermost or surrounding regions that are formed by the reinforcement material.

19. The metal-matrix composite tool of claim 16, wherein the median particle size is less than the surrounding particles.

20. The metal-matrix composite tool of claim 16, wherein the average particle size is less than surrounding regions.

* * * * *